US009062928B2

(12) United States Patent
Appleton

(10) Patent No.: US 9,062,928 B2
(45) Date of Patent: Jun. 23, 2015

(54) PNEUMATIC TOY GUN FOR SHOOTING SOFT BALLS AND NOZZLE THEREFOR

(71) Applicant: Thomas Appleton, Oshawa (CA)

(72) Inventor: Thomas Appleton, Oshawa (CA)

( * ) Notice: Subject to any disclaimer, the term of this patent is extended or adjusted under 35 U.S.C. 154(b) by 0 days.

(21) Appl. No.: 13/986,799

(22) Filed: Jun. 6, 2013

(65) Prior Publication Data

US 2013/0269669 A1 Oct. 17, 2013

Related U.S. Application Data

(63) Continuation-in-part of application No. 12/926,389, filed on Nov. 15, 2010, now abandoned.

(30) Foreign Application Priority Data

Nov. 16, 2009 (CA) ..... 2685644

(51) Int. Cl.

| | |
|---|---|
| ***F41B 11/89*** | (2013.01) |
| ***F41B 11/73*** | (2013.01) |
| ***F41A 17/44*** | (2006.01) |
| ***F41A 21/32*** | (2006.01) |
| *F41J 5/24* | (2006.01) |
| *F41B 11/62* | (2013.01) |

(52) U.S. Cl.

CPC ..... *F41B 11/73* (2013.01); *F41B 11/89* (2013.01); *F41J 5/24* (2013.01); *F41A 17/44* (2013.01); *F41A 21/32* (2013.01); *F41B 11/62* (2013.01)

(58) Field of Classification Search

CPC ..... F41B 11/642; F41B 11/89; F41B 11/64
USPC ..... 124/56, 60, 61, 65, 63, 73, 84, 83; 42/54, 55, 105; 102/485; 2/463

See application file for complete search history.

(56) References Cited

U.S. PATENT DOCUMENTS

| | | | | | |
|---|---|---|---|---|---|
| 771,751 | A | * | 10/1904 | Sanguinet | 42/54 |
| 1,900,790 | A | * | 3/1933 | Brandt | 102/485 |
| 2,505,428 | A | * | 4/1950 | Pope | 124/65 |
| 2,762,356 | A | | 9/1956 | Foster | |
| 3,318,033 | A | * | 5/1967 | Barr | 42/105 |
| 3,534,492 | A | * | 10/1970 | Amster | 42/105 |
| 3,620,162 | A | * | 11/1971 | King | 102/485 |
| 3,956,843 | A | * | 5/1976 | Litman | 42/105 |
| 3,981,093 | A | * | 9/1976 | Reed | 42/105 |
| 4,892,081 | A | * | 1/1990 | Moormann | 124/65 |
| 4,930,242 | A | * | 6/1990 | Bialy | 42/105 |
| 4,970,484 | A | | 11/1990 | Nijland et al. | |
| 5,195,752 | A | | 3/1993 | Reeves et al. | |
| 5,206,445 | A | * | 4/1993 | Comley et al. | 42/105 |
| 5,377,656 | A | * | 1/1995 | Lewinski et al. | 124/65 |
| 5,572,982 | A | | 11/1996 | Williams | |
| 6,343,431 | B1 | * | 2/2002 | Brunn | 42/105 |
| 7,603,998 | B2 | | 10/2009 | Finstad | |
| 7,793,643 | B2 | * | 9/2010 | Chen | 124/65 |
| 7,849,628 | B2 | * | 12/2010 | Condon et al. | 42/105 |
| 7,938,110 | B2 | * | 5/2011 | Udwin | 124/65 |
| 2007/0017498 | A1 | * | 1/2007 | Finstad | 124/84 |
| 2007/0234624 | A1 | * | 10/2007 | Brunn | 42/105 |
| 2011/0113539 | A1 | | 5/2011 | Appleton | |

* cited by examiner

*Primary Examiner* — Samir Abdosh
*Assistant Examiner* — John D Cooper
(74) *Attorney, Agent, or Firm* — Young & Thompson

(57) ABSTRACT

The pneumatic toy gun has a nozzle through which a soft ball travels. At one end of the nozzle there is an outlet from which the ball is expelled and at the other end there is an inlet for receipt of a stream of gas under pressure. A constriction such as fins or an annulus are mounted within the tube and function to inhibit the use of the gun to fire balls having a diameter smaller than that of balls which are intended to be shot from the toy gun.

11 Claims, 7 Drawing Sheets

PNEUMATIC TOY GUN FOR SHOOTING SOFT BALLS AND NOZZLE THEREFOR

CROSS REFERENCE TO RELATED PRIOR APPLICATION

This application is a Continuation-in-Part of application Ser. No. 12/926,389 filed on Nov. 15, 2010 now abandoned which application claims priority pursuant to 35 USC 119 of Canadian application no. 2,685,644 filed on Nov. 16, 2009 each of which applications is herein incorporated by reference in its entirety.

FIELD OF THE INVENTION

This invention relates to an attachment to a toy gun and more particularly to a nozzle which my be connected to a commercially available pneumatic toy gun to convert it to one which shoots harmless balls from a gun of conventional design such as a paint ball gun. The toy gun equipped with the nozzle is suitable for use in a game in which two or more players each have a like toy gun and each is wearing a garment having an impact sensor or detector. When the impact detector or sensor is struck by a ball, it activates a display such as a light, score board and the like to record a hit.

BACKGROUND OF THE INVENTION

Games are well known in which players have various forms of guns for shooting each other with harmless solid objects, liquids or beams of light and for recording the number of hits for determining the winners of the games. Such games can cause disagreements among the players for various reasons such as whether a hit has occurred or where a hit took place. For example, if the only way in which a hit is detected is whether the hit is seen by the person who shoots the gun that causes the hit or by the person who feels the hit, then disagreements about whether there was or was not a hit or where a hit occurred are bound to occur. Such disagreements can spoil a game that was otherwise enjoyed by the players.

Toy guns have been designed to detect a hit in such a way that there can be no dispute about whether it occurred or not. A paint ball gun for example shoots balls which rupture on impact and spray paint over the area where the impact takes place. The presence of the paint cannot be denied nor can its location. Questions about who was hit and by whom are answered quickly and with little or no arguments. However the consequences of a hit by a paint ball are not pleasant. The paint can permanently stain the players' clothing, enter his eyes or mouth and be very uncomfortable if it flows down his sleeves or down his neck and under his shirt.

SUMMARY OF THE INVENTION

I have invented a nozzle for a toy gun which shoots harmless balls from a gun of conventional design such as a paint ball gun or from a gun which is specifically designed for the purpose. The ball is composed of soft foam rubber or like soft material so that it does no harm to the person who is hit by it. The toy gun may be composed of a gun of conventional design such as a paint ball gun in which a nozzle of my design is substituted for the barrel of the paint ball gun. The nozzle may also be attached to the barrel.

The nozzle of my invention restricts the use of the toy gun to propelling soft foam rubber balls as described above which are frictionally secured in the wall surrounding the outlet of the nozzle before the gun is fired. The balls do not travel through the nozzle. My nozzle prevents balls which pass through the barrel of the gun, such as paint balls, to discharge from the nozzle. As a result, the toy gun cannot be used to fire such balls.

The toy gun may be used in a game in which the players each has one such gun and each wears a garment with an impact detector or sensor. When a ball hits the impact detector or sensor, the hit is displayed in such a way that there can be no dispute about whether it occurred or not. Finally, there is no trace of the hit on the person who was hit, the only evidence of it is on the display.

Briefly, the toy gun of my invention has a nozzle provided with an outlet defined by an annular wall. The outlet is adapted to receive an impellable ball having a flexible outer wall and a diameter slightly greater than that of the outlet such that the ball sealingly engages the annular wall when pressed into contact with it. The toy gun has a conduit through which compressed gas flows. The conduit extends to an inlet of the nozzle. A conventional valve controls the flow of compressed gas through the conduit. A trigger causes the valve to open with resulting flow of compressed gas to the nozzle for causing the impellable ball to be expelled from the outlet. At least one fin or other obstruction is disposed within the nozzle for blocking the passage of paint balls or other projectiles from entering the nozzle from its inlet and discharging from its outlet.

More specifically, my invention is a cylindrical nozzle adapted for use in conjunction with a pneumatic toy gun in which projectiles are discharged by means of a propellant consisting of a stream of gas under pressure. The nozzle has a longitudinal axis, cylindrical outlet and inlet at opposite ends of the longitudinal axis and co-axial therewith, and an interior. The nozzle is adapted to provide a passage for the stream of gas which enters through the inlet, flows through the interior and discharges from the outlet. The outlet has an annular wall which defines a circular opening and is adapted to receive an impellable ball having a flexible outer wall. The opening has a diameter slightly less than that of the impellable ball such that the impellable ball sealingly engages the annular first wall when pressed into contact therewith. A constriction within the interior lies radially outward of the longitudinal axis. The constriction is located such as to block the passage of any projectiles entering said interior from said inlet from passing through said interior and discharging from said outlet

DESCRIPTION OF THE DRAWINGS

The invention is described with reference to the accompanying drawings in which.

Figure 7:
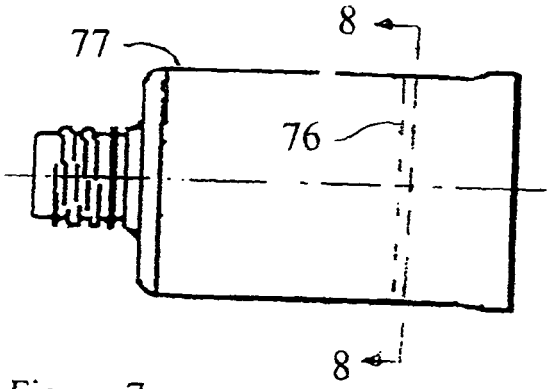
Figure 8:
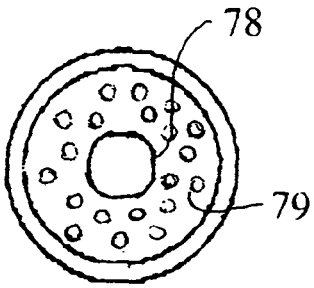
Figure 9:
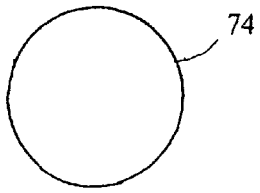
Figure 10:
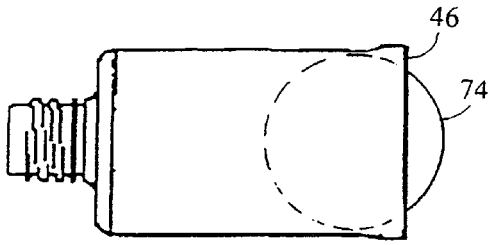
Figure 11:
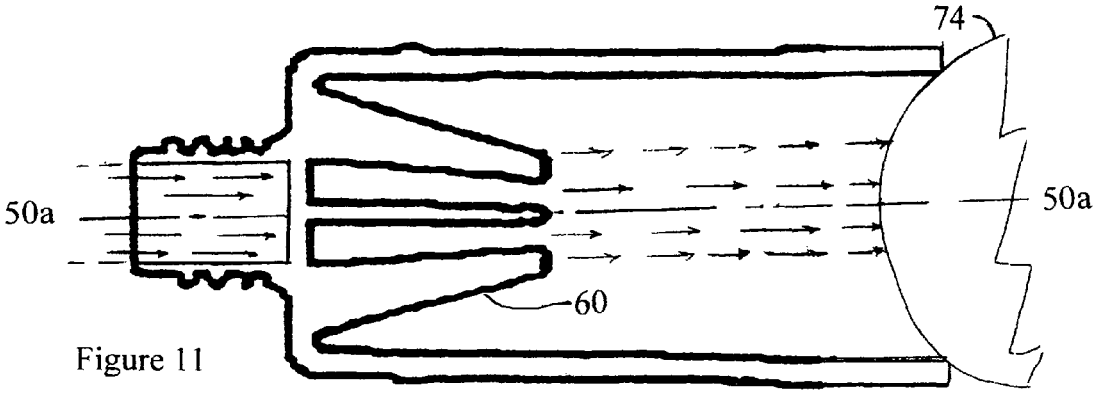
Figure 12:
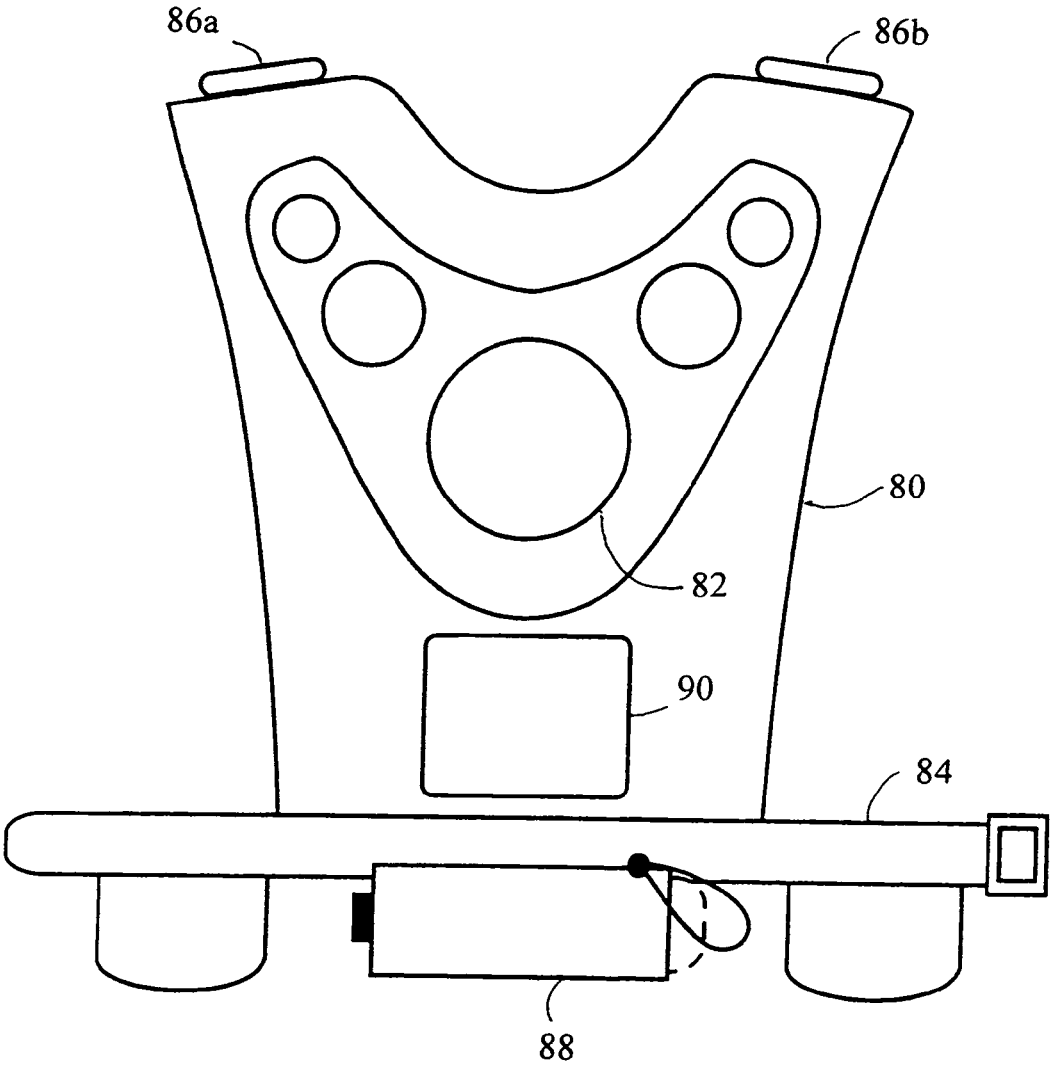
Figure 13:
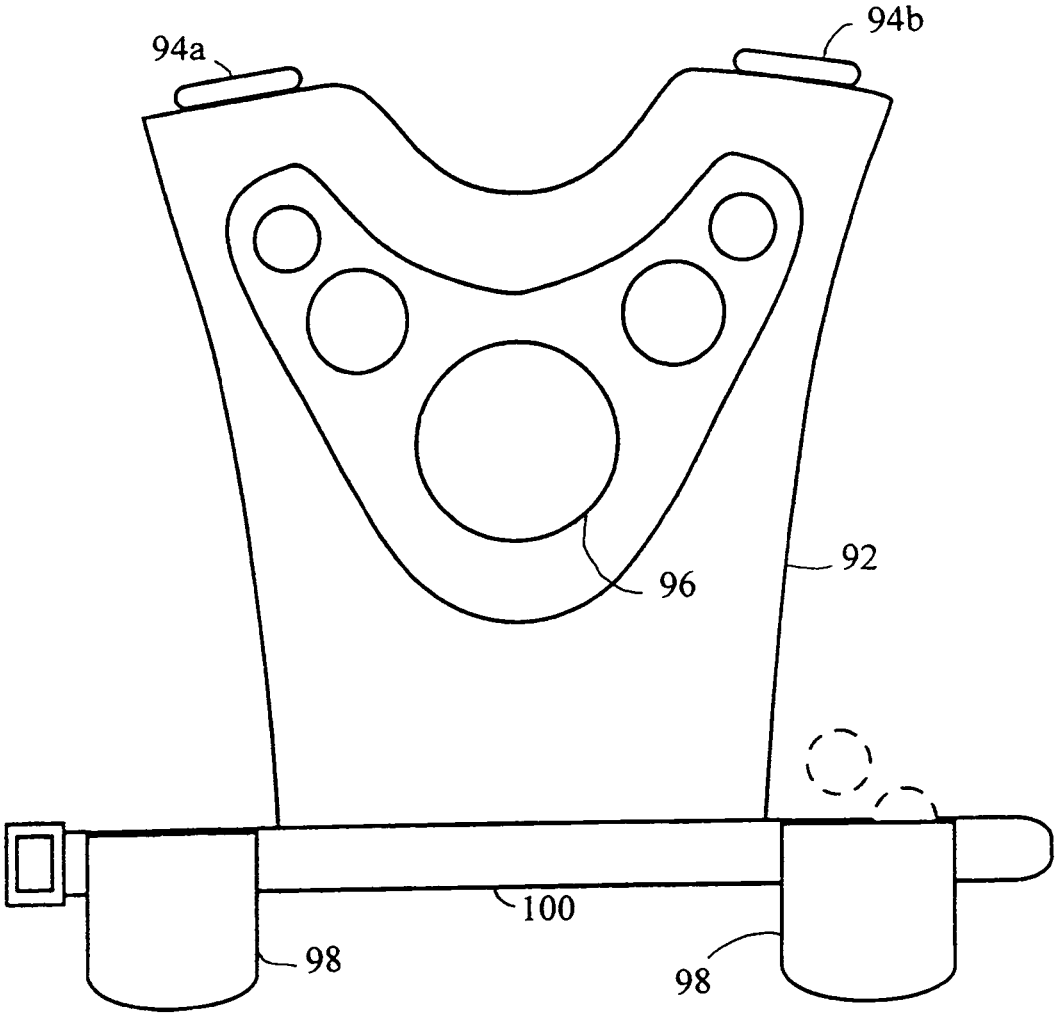

FIG. **6*a*** is another section of the nozzle, in enlarged scale, together with paint balls in various locations in the nozzle;

FIG. 7 is a elevation of the nozzle together with constriction within the nozzle;

FIG. 8 is an elevation on line 8-8 in FIG. 7;

FIG. 9 is an elevation of a conventional sponge rubber ball;

FIG. 10 is an elevation of the ball in conjunction of the nozzle of the invention;

FIG. 11 is section of the nozzle, in enlarged scale, together with the ball of FIG. 9; and FIGS. 12 and 13 are elevations of two embodiments of the vest of the invention.

Like reference characters refer to like parts throughout the description of the drawings.

DESCRIPTION OF PREFERRED EMBODIMENT

Figure 1:
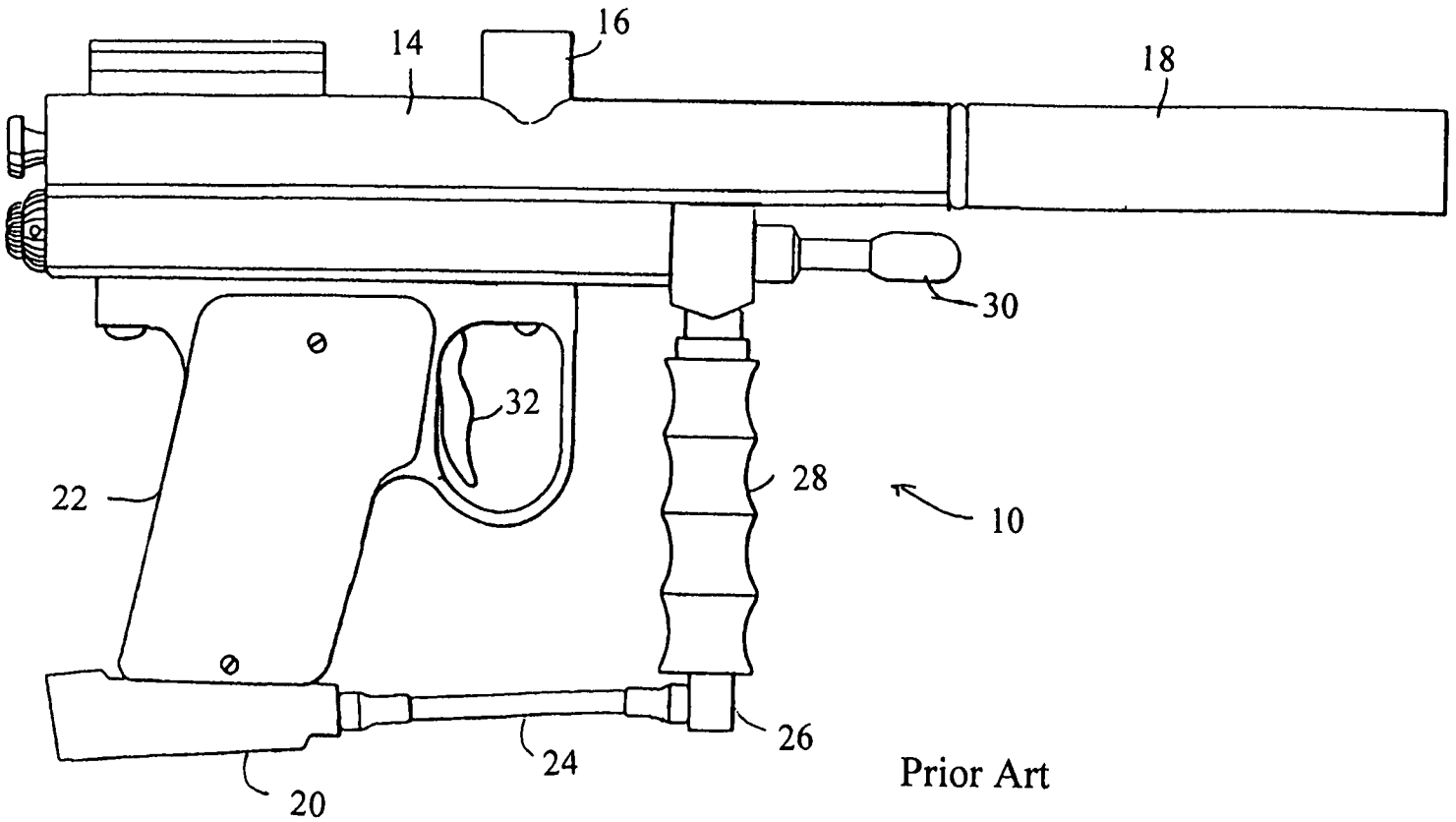
FIG. 1 is an elevation of a known paint ball gun.

With reference to FIG. 1, a toy gun, generally 10, is used to shoot paint balls and is typical of such guns. The toy gun is not the subject of the present invention. Paint balls are stored in a magazine (not illustrated) and are fed into the breech formed in the housing 14 of the gun through a feed tube 16. A passageway is formed in the housing which extends from the breech to the bore of the barrel 18. The barrel is removably attached to the housing by threads on its outer wall which mate with threads formed on the wall which defines the passageway in the housing.

A gas cylinder 20 containing carbon dioxide or air under pressure is attached to the bottom of the handle 22 of the toy gun. Gas from the cylinder flows through a hose 24 to an elbow 26 at the bottom of a hand grip 28 and from there flows through a tube in the hand grip to a compressed gas chamber 30 for holding the volume of gas necessary for each firing of the gun.

When the trigger 32 of the gun is pulled, one paint ball in the breech of the gun is driven by the compressed gas through the passageway in the housing and through barrel 18 and discharges through the open end of the barrel.

Figure 2:
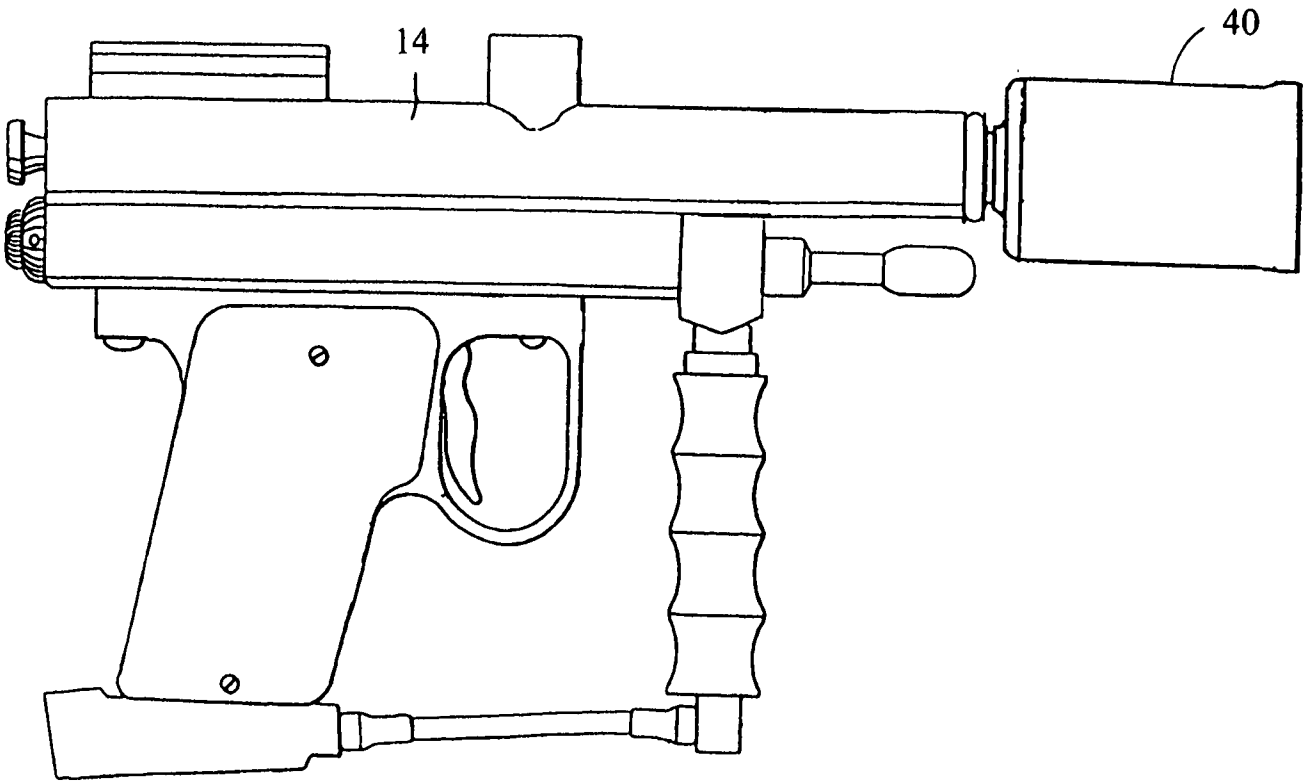
FIG. 2 is an elevation of the paint ball gun of FIG. 1 in which the nozzle of the invention has been substituted for the barrel of the gun.
Figure 3:
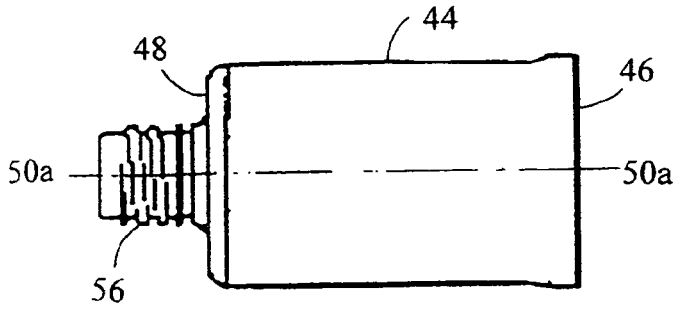
FIG. 3 is an elevation of the nozzle from a side.
Figure 5:
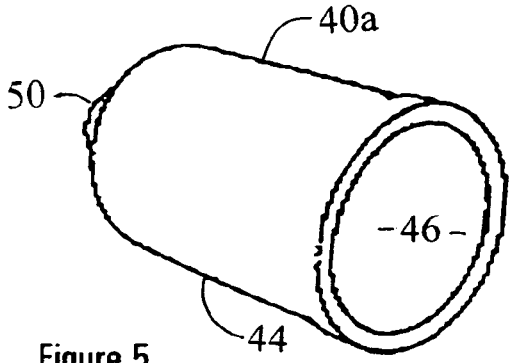
FIG. 5 is a perspective view of the nozzle.
Figure 6:
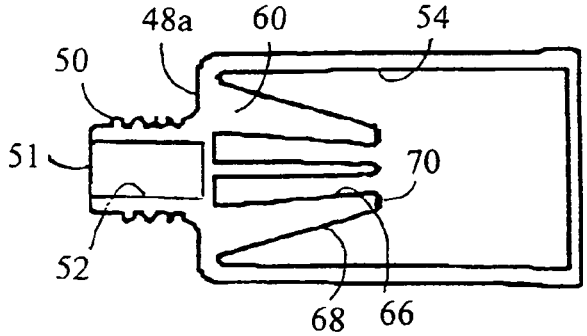
FIG. 6 is a section of the nozzle.

In FIG. 2, the barrel of the gun has been removed by unwinding it from housing 14 of the toy gun and has been replaced by the nozzle 40 of the invention. The nozzle is illustrated in more detail in FIGS. 3 to 6. With reference first to FIGS. 3, 5 and 6, the nozzle has a body 40*a* consisting of a hollow cylindrical wall 44 which is open at an outlet 46 and is partially closed at the other end by an annular end wall 48. Attached to the end wall is a cylindrical connector 50 having a longitudinal axis which is coaxial with the longitudinal axis of the cylindrical wall of the nozzle. The two axes are identified as 50*a*-50*a*.

The diameter of the inlet 51 and the inside passageway 52 of the connector may be smaller than that of the inner passageway 54 of the cylindrical wall. The two passageways 52, 54 are in fluid-flow communication with each other. The outer wall 56 of the connector is threaded for mating with the threads of the housing. The latter threads serve to connect the barrel of the gun to the housing.

Figure 4:
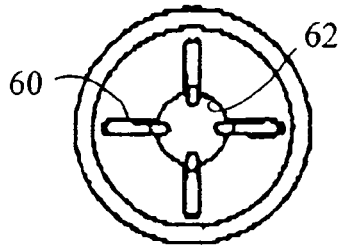
FIG. 4 is an elevation of the nozzle from an end.

With reference to FIGS. 4 and 6, mounted within the cylindrical wall of the nozzle is a number of fins or prongs 60. The fins extend radially outward from and extension of the inside passageway 52 of connector 50. Each fin is integral with end wall 48 of the nozzle and has an inner edge 66 which converges with like edges of the remaining fins.

The fins are constructed and oriented such as to cause a laminar flow of pressurized gas through the nozzle. The fins have however another purpose which is to inhibit a toy gun equipped with the nozzle from being used to fire balls which are smaller than those intended to be shot from the gun.

Figure 6A:
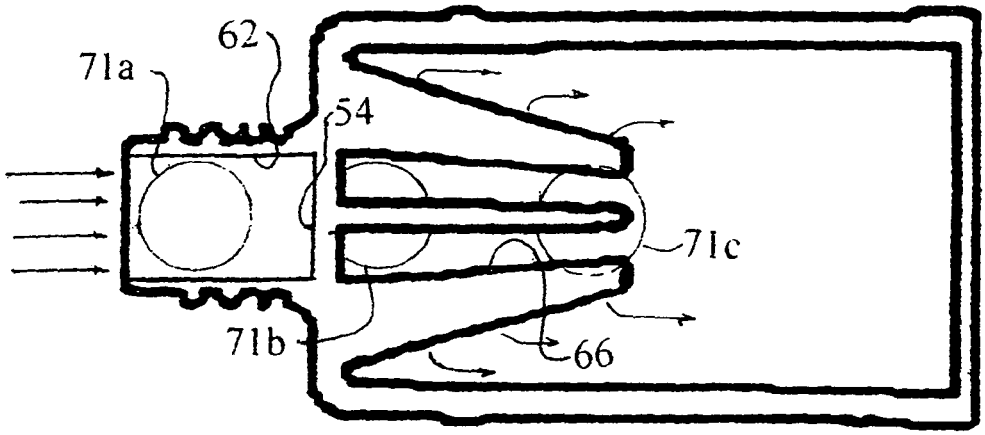

With reference to FIG. 6*a*, the diameter of a paint ball 71 is less than that of the inside passageway 52 of the connector and the inlet 54 into the body 40*a* of the nozzle. The paint ball is free to travel along the inside passageway and into the body of the nozzle as illustrated by paint balls 71*a* and 71*b*. However as the inside edges of the fins converge, the paint ball is eventually trapped by the inside edges when it reaches the position illustrated by paint ball 71*c*. The fins accordingly allow pressurized gas to flow through the inside passageway and into the body of the nozzle and outwardly through outlet 46 of the body but prevent paint balls from discharging through the outlet.

The fins also prevent a paint ball from being inserted into the opposite end of the nozzle, i.e. through outlet 46 and being fired by the toy gun. This is because if a paint ball is inserted into the nozzle body from outlet 46 and pressed against the downstream ends 70 of the fins in order to immobilize it, a substantial proportion of the pressurized gas flowing downstream through the nozzle will flow not against the ball but radially outwardly through the space between adjacent fins. Relatively little of the gas will flow against the ball. The fins accordingly function to divert compressed gas issuing from the connector away from a paint ball and not against it.

The fins accordingly function as a constriction in the nozzle for paint balls which enter the nozzle body from inlet 51. The fins allow compressed gas to flow along the longitudinal axis of the nozzle and adjacent to it unless a ball enters the nozzle from the inlet. When the ball becomes lodged between the fins, compressed gas will flow through the space between adjacent fins and exit through outlet 46 but the ball will be immobilized within the nozzle.

As illustrated in FIG. 6*a*, the fins lie radially outward of the longitudinal axis of the nozzle and function to prevent the passage of any paint balls or other projectiles from entering the the inlet and discharging from the outlet of the nozzle but, in the absence of such projectiles, all of the stream of gas flows unimpeded directly from the inlet along a path surrounding the longitudinal axis.

The constriction in the body of the nozzle can be various shapes and sizes and need not be in the shape of fins. In FIGS. 7 and 8, for example, the constriction is in the shape of an annulus 76. The annulus is located in the interior of the nozzle 77 and serves the same purpose as fins 60. The central opening 78 of the annulus is smaller than the circumference of a paint ball so that a ball cannot pass through the opening. The annulus however allows a stream of compressed gas to flow along and adjacent to the longitudinal axis of the nozzle in the same manner as fins 60. The walls of the annulus are perforated at 79 to allow the compressed gas to pass through the nozzle but are too small to allow the ball to pass through the perforations.

With reference to FIGS. 9-11, ball 74 which the toy gun is designed to shoot when equipped with the nozzle of the invention is preferably composed of soft foam rubber.

The ball is sometimes referred to below and throughout the claims as an "impellable ball" since it is impelled by compressed gas from the nozzle of the toy gun. The ball should be composed of light weight material and have a soft outer wall. The core of the ball need not be soft but preferably is since harder material tends to weigh more than soft material and acts to slow the speed of the ball. Softness and light weight are preferred attributes of the ball since the purpose of the game which is played with the toy gun and ball involves shooting balls at players, Obviously the game will not be enjoyable if players are hurt or injured by the balls.

With reference to FIGS. 10 and 11, loading of the ball involves pushing it inward into the fully open end or outlet 46 of the nozzle in order to sealingly engage the ball to the outlet. The diameter of the annular wall which defines the outlet should be slightly less than the diameter of the ball so that the ball will stay put in the nozzle when it is pushed against it. The ball should remain attached to the nozzle no matter how the toy gun is held and should only disengage from the outlet out when the ball is subjected to a blast of compressed gas.

Fins 60 lie radially outward of the longitudinal axis of the body of the nozzle and are located such as to prevent the passage of any paint balls which enter the nozzle from the inlet from discharging from the outlet as previously mentioned but, in the absence of such paint balls, allows the stream of gas to flow in the direction of the arrows unimpeded directly from the inlet along a path surrounding the longitudinal axis of the nozzle and directly into contact with bal 74.

With reference to FIG. 12, a vest 80 is adapted to be worn over the chest of a player of the game played with the toy gun of the invention. The vest is equipped with a conventional impact detector 82, a belt 84 for holding the vest to the body of the player, lights 86*a,b* in the shoulder areas of the vest, a pouch 88 for extra gas cylinders of $CO_2$ or air and a pouch 90 for batteries and a radio transmitter.

A more simplified vest is illustrated in FIG. 13. In that drawing, vest 92 provided with lights 94*a,b*, an impact sensor 96, pouches 98 for balls and a belt 100 to which the pouches for balls are attached. However, pouches for batteries, radio transmitter and gas cylinders are dispensed with in vest 92.

When the impact indicators are struck by a ball, they activate lights 86*a,b* and 94*a,b* on the vests and also, with respect to vest 80, a display (not illustrated) remote from the vest. The display indicates the number of hits and also the identity of the player whose ball struck impact indicator 82. The display can also be on vest 80 itself or on a scoreboard.

The scoreboard is preferably separate from vest 80 and is activated by radio signals from the radio transmitter which in turn is activated by impact indicator 82. The scoreboard accordingly indicates the number of hits on vest 80 and the source of each hit The scoreboard can also have an timer for recording the time when the hits occurred and for timing the length of each game.

There are a number of impact indicators which are suitable for detecting and communicating hits on a vest. U.S. Pat. No. 5,092,607 to Ramsay et al, U.S. Pat. No. 5,575,479 to Ayres and U.S. Pat. No. 4,440,400 to Neuberger all describe impact indicators which are suitable for this purpose.

It will be understood, of course, that modifications can be made in the nozzle and vests of the invention without departing from the scope and purview of the invention as defined in the appended claims.

I claim:

1. A pneumatic toy gun, comprising:

a nozzle comprised of a tube with a longitudinal axis, an annular wall, an outlet end, and an opposite, inlet end that receives a stream of compressed gas under pressure when the gun is fired, the tube having a length between the inlet end and the outlet end, the outlet end having a diameter;

a foam rubber ball with flexible outer wall and a diameter greater than the diameter of the outlet end of the tube, the ball sealingly engaging the annular wall and frictionally secured in a portion of the wall of the tube surrounding the outlet end before the gun is fired and the stream of compressed gas under pressure is received, wherein during operation of the gun and receipt of the stream of compressed gas under pressure, the ball discharges from the tube by being expelled from the outlet end under pressure of the stream of compressed gas without travelling through the length of the tube; and a constriction comprising fins mounted within an interior of the tube radially outward of the longitudinal axis of the tube and having inside edges that converge inwardly towards each other, the constriction having a diameter smaller than a diameter of the ball, wherein the constriction blocks passage of any projectile entering said interior of the tube from the inlet end, from passing through said interior and discharging from the outlet end of the tube, wherein the outlet end of the tube defines a circular opening adapted to receive the ball, a diameter of the opening of the outlet end of the tube being less than the diameter of the ball.

2. The pneumatic toy gun of claim 1, further comprising:

a conduit through which compressed gas flows, the conduit extending to the inlet end of the tube, a valve the controls a flow of the compressed gas through the conduit, and a trigger connected to open the valve so that a resulting flow of the compressed gas to the tube causes the ball to be expelled from the outlet end of the tube.

3. The pneumatic toy gun of claim 1, wherein, the tube comprises:

a body (40*a*), an interior of which defines the annular wall (44) and the outlet end (46) of the tube, the body comprising an annular end wall (48) defining an inner passageway (54) of the tube, the inner passageway (54) having an inside diameter, and a cylindrical connector (50) having a longitudinal axis attached to the annular end wall and defining an inlet passageway (52) with an inside diameter, a longitudinal axis of the cylindrical connector being coaxial with a longitudinal axis of the body, an inlet (51) of the cylindrical connector (50) defining the inlet of the tube, the inlet (51) of the cylindrical connector (50) having an inside diameter, the inner passageway (54) being in fluid communication with the inlet passageway (52).

4. The pneumatic toy gun of claim 3, wherein, the inside diameter of the inlet (51) of the cylindrical connector (50) and the inside diameter of the inlet passageway (52) of the connector are each smaller than the inside diameter of the inner passageway (54).

5. The pneumatic toy gun of claim 3, wherein, the cylindrical connector (50) comprises a threaded outer wall (56) for mating.

6. A nozzle for a pneumatic toy gun, comprising:

a tube with a longitudinal axis, an annular wall, an outlet end, and an opposite, inlet end that receives a stream of compressed gas under pressure, the tube having a length between the inlet end and the outlet end, the outlet end having a diameter;

a foam rubber ball with flexible outer wall and a diameter greater than the diameter of the outlet end of the tube, the ball sealingly engaging the annular wall and frictionally secured in a portion of the wall of the tube surrounding the outlet end before the stream of compressed gas under pressure is received, wherein receipt of the stream of compressed gas under pressure, the ball discharges from the tube by being expelled from the outlet end under pressure of the stream of compressed gas without travelling through the length of the tube; and a constriction mounted within an interior of the tube radially outward of the longitudinal axis of the tube, the constriction having a diameter smaller than a diameter of the ball, wherein the constriction blocks passage of any projectile entering said interior of the tube from the inlet end, from passing through said interior and discharging from the outlet end of the tube, wherein the outlet end of the tube defines a circular opening adapted to receive the ball, a diameter of the opening of the outlet end of the tube being less than the diameter of the ball, and wherein, and the tube comprises i) a body (40*a*), an interior of which defines the annular wall (44) and the outlet end (46) of the tube, the body comprising an annular end wall (48) defining an inner passageway (54) of the tube, the inner passageway (54) having an inside diameter, and ii) a cylindrical connector (50) having a longitudinal axis attached to the annular end wall and defining an inlet passageway (52) with an inside diameter, a longitudinal axis of the cylindrical connector being coaxial with a longitudinal axis of the body, an inlet (51) of the cylindrical connector (50) defining the inlet of the tube, the inlet (51) of the cylindrical connector (50) having an inside diameter, the inner passageway (54) being in fluid communication with the inlet passageway (52), wherein, the constriction comprises fins (60) mounted within the inner passageway (54), each of the fins extending radially outward from and as an extension of the inlet passageway (52) of the connector (50), each fin being integral with the annular end wall (48) and having an inner edge (66) which converges, at a distal end of the fins, with like edges of the other fins, such that a distance between the inner edges (66) of the fins is greater at the annular end wall than a corresponding distance between the inner edges (66) of the fins at the distal ends of the fins, thereby trapping and preventing objects having a diameter greater the corresponding distance between the inner edges (66) of the fins at the distal ends of the fins from being projected out from between the inner edges (66) of the fins.

7. The nozzle of claim 6, wherein, the fins each lie radially outward of the longitudinal axis of the body (40*a*) and prevent passage of paint balls through the inner passageway (54).

8. A nozzle for a pneumatic toy gun and a ball, the nozzle comprising:

a tube with a longitudinal axis, an annular wall, an outlet end, and an opposite, inlet end that receives a stream of compressed gas under pressure, the tube having a length between the inlet end and the outlet end, the outlet end having a diameter, the inlet end of the tube being attachable to the toy gun, wherein the ball is a foam rubber ball and has a flexible outer wall and a diameter greater than the diameter of the outlet end of the tube, the ball sealingly engages the annular wall and is frictionally secured in a portion of the wall of the tube surrounding the outlet end before the stream of compressed gas under pressure is received, wherein upon receipt of the stream of compressed gas under pressure, the ball discharges from the tube by being expelled from the outlet end under pressure of the stream of compressed gas without travelling through the length of the tube; and a constriction comprising fins mounted within an interior of the tube radially outward of the longitudinal axis of the tube and having inside edges that converge inwardly towards each other, the constriction having a diameter smaller than a diameter of the ball, wherein the constriction blocks passage of any projectile entering said interior of the tube from the inlet end, from passing through said interior and discharging from the outlet end of the tube, wherein the outlet end of the tube defines a circular opening adapted to receive the ball, a diameter of the opening of the outlet end of the tube being less than the diameter of the ball.

9. The nozzle of claim 8, wherein, the tube comprises:

a body (40*a*), an interior of which defines the annular wall (44) and the outlet end (46) of the tube, the body comprising an annular end wall (48) defining an inner passageway (54) of the tube, the inner passageway (54) having an inside diameter, and a cylindrical connector (50) having a longitudinal axis attached to the annular end wall and defining an inlet passageway (52) with an inside diameter, a longitudinal axis of the cylindrical connector being coaxial with a longitudinal axis of the body, an inlet (51) of the cylindrical connector (50) defining the inlet of the tube, the inlet (51) of the cylindrical connector (50) having an inside diameter, the inner passageway (54) being in fluid communication with the inlet passageway (52).

10. The nozzle of claim 9, wherein, the inside diameter of the inlet (51) of the cylindrical connector (50) is smaller than the inside diameter of the inner passageway (54).

11. The nozzle of claim 9, wherein, the cylindrical connector (50) comprises a threaded outer wall (56) for mating with threads.

* * * * *